US008727342B2

(12) United States Patent
Fukumoto et al.

(10) Patent No.: US 8,727,342 B2
(45) Date of Patent: May 20, 2014

(54) FEEDING DEVICE AND IMAGE FORMING APPARATUS

(75) Inventors: Takashi Fukumoto, Miyagi (JP); Hideaki Takahashi, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/480,705

(22) Filed: May 25, 2012

(65) Prior Publication Data

US 2012/0313315 A1 Dec. 13, 2012

(30) Foreign Application Priority Data

Jun. 8, 2011 (JP) ..... 2011-128594

(51) Int. Cl.
*B65H 1/00* (2006.01)

(52) U.S. Cl.
USPC ..... 271/171; 271/125

(58) Field of Classification Search
USPC ..... 271/145, 171, 170, 122, 125, 121, 233, 271/253, 254, 255, 1, 241
See application file for complete search history.

(56) References Cited

U.S. PATENT DOCUMENTS 6,224,049 B1 * 5/2001 Hosking et al. ..... 271/10.03
6,409,165 B1 * 6/2002 Yamaoka et al. ..... 271/145
7,290,764 B2 * 11/2007 Marasco ..... 271/145
2003/0025263 A1 * 2/2003 Koga ..... 271/9.12
2010/0166484 A1 * 7/2010 Edwards et al. ..... 400/642

FOREIGN PATENT DOCUMENTS

| | | | |
|---|---|---|---|
| GB | 2101082 | * | 1/1983 |
| JP | 1-92137 | * | 4/1989 |
| JP | 2000-229732 | * | 8/2000 |
| JP | 2001-130752 B2 | | 5/2001 |
| JP | 3773724 B2 | | 2/2006 |
| JP | 2007-168940 | * | 7/2007 |
| JP | 2008-169021 | * | 7/2008 |

OTHER PUBLICATIONS

Machine translation of JP2000-229732.*

* cited by examiner

*Primary Examiner* — Thomas Morrison

(57) ABSTRACT

A feeding device includes a carrying roller to carry a top sheet of sheets in a conveying direction, a reverse roller to transfer subsequent sheets beneath the top sheet in a direction opposite to the conveying direction while being moved in the conveying direction with the top sheet, and an end fence to restrict rear end positions of the subsequent sheets. The end fence includes an upper contacting member to come into contact with an upper surface of the top sheet, and a restricting member extending from the upper contacting member along a rear end surface of the sheets to stop rear ends of the sheets in its entire width direction, the upper contacting member and the restricting member being arranged such that a width dimension of the end fence is changeable in the width direction, and the end fence being arranged above the top sheet.

9 Claims, 10 Drawing Sheets

FEEDING DEVICE AND IMAGE FORMING APPARATUS

BACKGROUND OF THE INVENTION

1. Field of the Invention

The disclosures herein relate to a feeding device and an image forming apparatus.

2. Description of the Related Art

A feeding device for feeding sheets of paper on which an image is transferred is generally provided in image forming apparatuses such as an electronographic copier, a facsimile machine, a printer and a printer device. Such a feeding device may include a multi-feed preventing mechanism.

An example of the multi-feed preventing mechanism includes a mechanism configured to carry only a top one of layers of sheets S separately from the rest of the sheets S by utilizing the difference between the coefficient of friction of the layers of sheets S and the coefficient of friction of a transport member that comes into contact with the layers of sheets S.

FIGS. 9A, 9B and 9C are cross-sectional diagrams illustrating a configuration of a related art feeding device. The related art feeding device includes a multi-feed preventing mechanism formed of a pair of feed rollers 201 and 202 that come into contact with each other so as to move in cooperation with each other at a front part in a feeding direction indicated by an arrow F, and a carrying roller 203 located behind the pair of the feed rollers 201 and 202 and configured to be rotatable by intermittently coming into contact with a top one of the layers of sheets S loaded on a not-illustrated feed stand.

The feed roller 201 is located above the feed roller 202 and configured to be rotationally driven to feed the sheets S in a sheet feeding direction. The feed roller 202 is configured to be rotationally driven to transfer the sheets S in a returning direction opposite to the sheet feeding direction. The coefficient of friction between the pair of the feed rollers 201 and 202 and the layers of sheets S may include the following relationship.

Specifically, the coefficient of friction between the feed roller 202 and the remaining sheets S other than the top sheet is greater than the coefficient of friction between the layers of sheets S, and the coefficient of friction between the feed roller 201 and the top sheet is greater than the coefficient of friction between the feed roller 202 and the remaining sheets S. With this configuration, when the plural remaining sheets S other than the top sheet are carried together with the top sheet S, the top sheet S is carried by the feed roller 201 while the remaining sheets S1 (FIG. 9B) are returned in the returning direction opposite to the sheet feeding direction by rotational force of the feed roller 202.

The sheets returning toward the feeding device side from a transfer position, at which the top sheet S is sandwiched between the feed rollers 201 and 202, may be shifted in the sheet feeding direction from aligned rear ends of other remaining sheets loaded on the feed stand as illustrated in FIG. 9C.

In a case where the rear ends of the returning sheets are shifted in the sheet feeding direction and located behind the rear ends of the other remaining sheets, the returning sheets may shift (miss) the carrying position at which the carrying roller 203 carries the top sheet. As a result, the next sheet subsequent to the top sheet may not be carried.

Hence, in order to set rear end positions of the returning sheets S returning in the sheet feeding direction toward the feed stand side from the transfer position at which each of the sheets S is sandwiched between the feed rollers 201 and 202, a fence member 205 is arranged at a predetermined position in the feeding device as illustrated in FIGS. 9A and 9B. Accordingly, the rear end positions of the returning sheets are restricted to facilitate carrying of a next one of the sheets subsequent to the top sheet.

Recent image forming apparatuses are desired to be capable of forming images on sheets of various sizes or various types required by a user. Some of these image forming apparatuses may be configured to carry out bookbinding by themselves. In such an integrated bookbinding task, tab-attached sheets serving as index sheets may be utilized for assortment, delimiting, and header attachment.

FIG. 10 is a diagram illustrating arrangement of a tab-attached sheet, where (a) is a plan diagram of the tab-attached sheet and (b) is a schematic side diagram illustrating layers of the tab-attached sheets loaded on the feed stand.

In FIG. 10, when the feeding device transfers a tab-attached sheet TS, transfer failure may occur by simply pressing part of the tab-attached sheet TS. That is, as illustrated in FIG. 10, since it is necessary to restrict positions of rear ends of tabs T of the tab-attached sheets TS, the fence member 205 may be located in line with a position at which a dimension (indicated by "R" in FIG. 10) corresponding to a projected amount of the tab T is shifted rearward from the rear ends of the sheets TS.

However, in order for the next sheet to be carried, it may be necessary to locate a front end of the tab-attached sheet TS within a distance (indicated by Q in FIG. 10) from a position of a sheet end touching member 206 located corresponding to the front end side in the sheet feeding direction to a position at which the carrying roller 203 comes into contact with the tab-attached sheet TS.

Note that when a relationship $Q>R$ is established, the next sheet may be carried. On the other hand, when a relationship $Q<R$ is established, the front end of the sheet TS will not reach the carrying roller 203. As a result, the next sheet may not be carried.

However, some types of the tab-attached sheets include tabs formed at slightly different locations of the rear ends of the tab-attached sheets such that the tabs will not be located at the same positions of the tab-attached sheets. There are proposed numerous technologies that may employ sheets of a tab-attached sheet type having tabs slightly arranged at different locations of the rear ends of the sheets.

For example, Japanese Patent No. 3773724 (hereinafter also referred to as "Patent Document 1") discloses a feeding device including an end fence to restrict positions of rear ends of the returned sheets S. The end fence includes a restricting face for arresting the rear ends of the sheets S in an entire width direction of the sheets S and is located on an upper surface of the top sheet of the layers of sheets S.

FIGS. 11A, 11B and 11C are diagrams illustrating an example of the related art feeding device. FIG. 11A is a perspective diagram of the end fence utilized in the related art feeding device, FIG. 11B is a perspective diagram of the related art feeding device and FIG. 11C is a cross-sectional diagram of the related art feeding device.

In the related art feeding device illustrated in FIGS. 11A, 11B and 11C, an end fence 215 is arranged on an upper surface of a top sheet of layers of tab-attached sheets TS loaded on the feed stand. As illustrated in FIGS. 11A and 11C, the end fence 215 includes a setting face 215A setting on the upper surface of the top sheet and a restricting piece extending from the setting face 215 and being folded at a right angle. The setting face 215A includes a "U-shape" in a horizontal view. The setting face 215A is configured to only touch a rear end and two ends in a width direction of the sheet S.

As illustrated in FIG. 11B, the restricting piece 215B includes a restricting face configured to touch the rear end of the sheet S in an entire width direction. Accordingly, a position of the rear end of the sheet S may be restricted in the entire width direction of the sheet S. The setting face 215A and the restricting piece 215B are symmetrically arranged based on a center of the sheet S in the width direction.

Due to diversified sizes and types of sheets of paper desired by users, a recent image forming apparatus may need to form images on sheets of various sizes and various types.

However, the end fence of the related art feeding device is compatible with only one type of a sheet size. Hence, plural end fences may need to be prepared when the user desired to use the tab-attached sheets of various types and various sizes.

RELATED ART DOCUMENT

Patent Document

Patent Document 1: Japanese Patent No. 3773724

SUMMARY OF THE INVENTION

It is a general object of at least one embodiment of the present invention to provide a feeding device, an image forming apparatus capable of transferring various types of tab-attached sheets without replacing the end fence, which may substantially eliminate one or more problems caused by the limitations and disadvantages of the related art.

According to one embodiment, there is provided a feeding device that includes a carrying roller configured to carry a top sheet from a bundle of loaded sheets in a conveying direction; a reverse roller configured to transfer subsequent sheets subsequently layered beneath the top sheet in a direction opposite to the conveying direction while the subsequent sheets being moved in the conveying direction together with the top sheet; and an end fence configured to restrict rear end positions of the subsequent sheets transferred in the direction opposite to the conveying direction. In the feeding device, the end fence includes an upper contacting member configured to come into contact with an upper surface of the top sheet; and a restricting member extending from the upper contacting member along a rear end surface of the bundle of the loaded sheets and configured to stop rear ends of the sheets in an entire width direction of the sheets by allowing the rear ends of the sheets to come into contact with the restricting member. The upper contacting member and the restricting member of the end fence are arranged such that a width dimension of the end fence is changeable in a width direction of the sheets, and the end fence is arranged above the top sheet of the bundle of the loaded sheets.

According to another embodiment, there is provided an image forming apparatus that includes the aforementioned feeding device; and an image forming unit configured to form an image on a desired one of sheets transferred from the feeding device.

Additional objects and advantages of the embodiments will be set forth in part in the description which follows, and in part will be obvious from the description, or may be learned by practice of the invention.

It is to be understood that both the foregoing general description and the following detailed description are exemplary and explanatory only and are not restrictive of the invention, as claimed.

BRIEF DESCRIPTION OF THE DRAWINGS

Other objects and further features of embodiments will be apparent from the following detailed description when read in conjunction with the accompanying drawings, in which:

FIG. 6A is a perspective diagram of the end fence in an expanded status and FIG. 6B is a perspective diagram of the feeding device in a contracted status;

FIG. 11A is a perspective diagram of the end fence, FIG. 11B is a perspective diagram of the related art feeding device and FIG. 11C is a cross-sectional diagram of the related art feeding device.

DESCRIPTION OF THE PREFERRED EMBODIMENTS

Preferred embodiments are described below with reference to the accompanying drawings.

Preferred embodiments are described below with reference to the accompanying drawings.

[First Embodiment]

Figure 1:
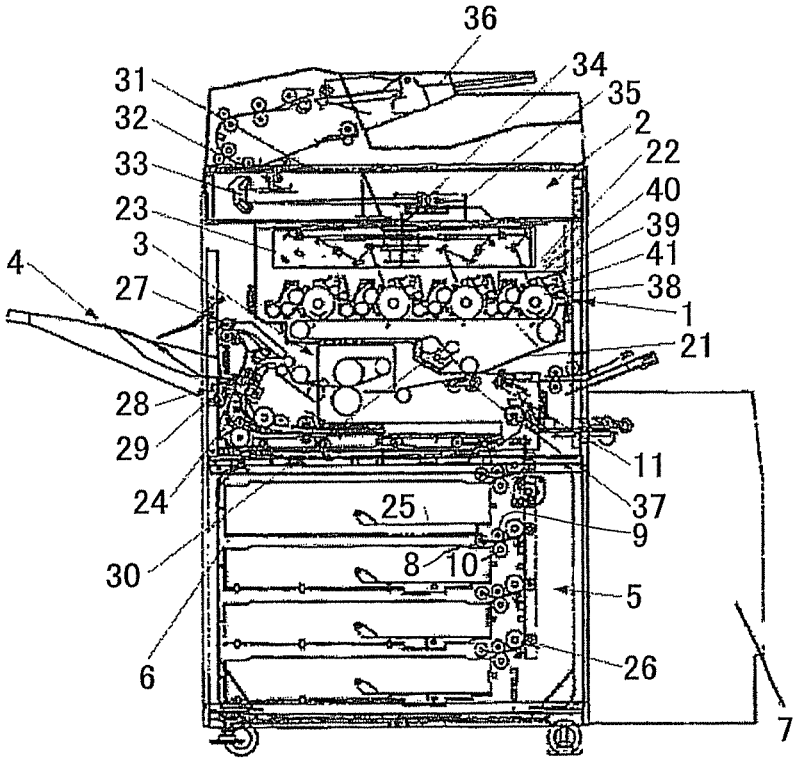
FIG. 1 is a cross-sectional diagram illustrating a general configuration of an image forming apparatus according to a first embodiment.

In the following, a description is given, with reference to the accompanying drawings, of an image forming apparatus according to a first embodiment. FIG. 1 is a cross-sectional diagram illustrating a general configuration of the image forming apparatus according to the first embodiment. The image forming apparatus is configured to function as a so-called "digital color copier" that scans a document to form a copy of the scanned document by converting the scanned document into a digital image to form the digital image on a sheet.

In FIG. 1, the image forming apparatus includes an image forming part 1, a reader 2, a fixer 3, a sheet-receiver 4 and the like. The image forming apparatus further includes a multi-stage sheet-feeder 5 at a lower part of the image forming apparatus. Each of the stages of the sheet-feeder 5 includes a sheet-feeder tray 6 serving as a feeding device on which plain sheets of paper, coated sheets of paper, overhead projector (OHP) films or the like are loaded.

The sheet-feeder 5 may optionally include an additional large-capacity sheet-feeding device 7. When an image is formed by such an image forming apparatus, each of sheets in layers is sequentially separated from the rest of the layers of the sheets residing in a selected one of the sheet-feeder trays 6 and the large-capacity sheet feeding device 7. That is, a top sheet of the layers of the sheets residing in the sheet-feeder tray 6 is fed by the rotation of the carrying roller 8 while a reverse roller 10 separates the top sheet from the rest of the sheets. The separated sheet is fed from the sheet-feeder tray 6 and then transferred to a resist roller 11 arranged downstream in a transfer direction of the transferred separated sheet by the rotation of a feed roller 9.

When the separated sheet transferred by the rotation of the feed roller 9 touches a nip of the resist roller 11, the transfer of the sheet is temporarily stopped and the temporarily stopped sheet is in a standby mode. The temporarily stopped sheet is then transferred to the image forming part 1.

Note that as illustrated in FIG. 1, the image forming apparatus includes an intermediate transfer belt 21, an image creating part 22, an exposure device 23, a duplex device 24, a base plate 25 of the sheet-feeder tray 6, a feed roller 26, a discharge roller 27, a reverse discharge roller 28, a dividing claw 29 and an intermediate transfer cleaning device 30. In addition, the image forming apparatus further includes a contact glass 31, carriers 32 and 33, a lens 34, a CCD 35, an automatic-document feeder 36, a discharging device 37, a photoreceptor 38, a charging device 39, a development device 40 and a cleaning device 41. These elements are not directly associated with the characteristics of the image forming apparatus according to the first embodiment. Therefore, illustrations of these elements are omitted from the specification.

Figure 2:
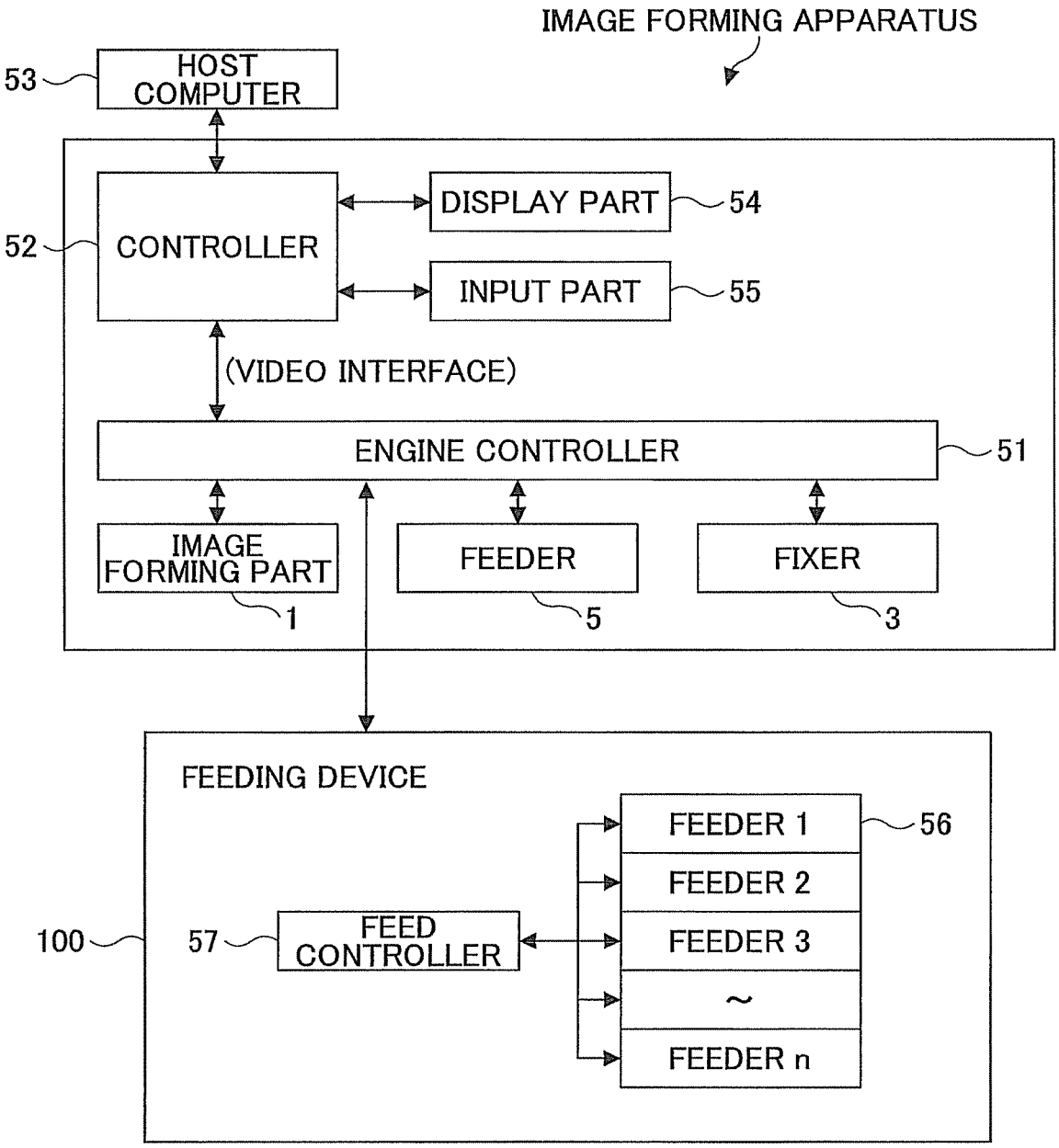
FIG. 2 is a block diagram illustrating a main control unit of the image forming apparatus according to the first embodiment.

Next, a control unit of the image forming apparatus according to the first embodiment is described. FIG. 2 is a block diagram illustrating a main control unit of the image forming apparatus according to the first embodiment. The image forming apparatus according to the first embodiment includes an engine controller 51 and a controller 52. The engine controller 51 is configured to control operations of the image forming part 1, the sheet-feeder 5, the fixer 3 and the like.

The controller 52 is connected to an external host computer 53, a display part 54, an input part 55 and the like, and configured to acquire external information necessary for the above operations, manage the acquired information and provide information necessary for the engine controller. Hence, the controller 52 manages operations of an entire system. Further, the controller 52 is provided with a feeding device 100 formed of a sheet-feeder 56 having at least one sheet-feeder (1 to n) and a feed controller 57 configured to control supply and transfer of the sheets.

The feeding device 100 corresponds to the aforementioned large-capacity sheet feeding device 7. Note that in this example, the feeding device 100 is provided separately (optionally) from a main body of the image forming apparatus. However, the feeding device 100 may be incorporated together with the sheet-feeder 5 in the main body of the image forming apparatus.

Figure 3:
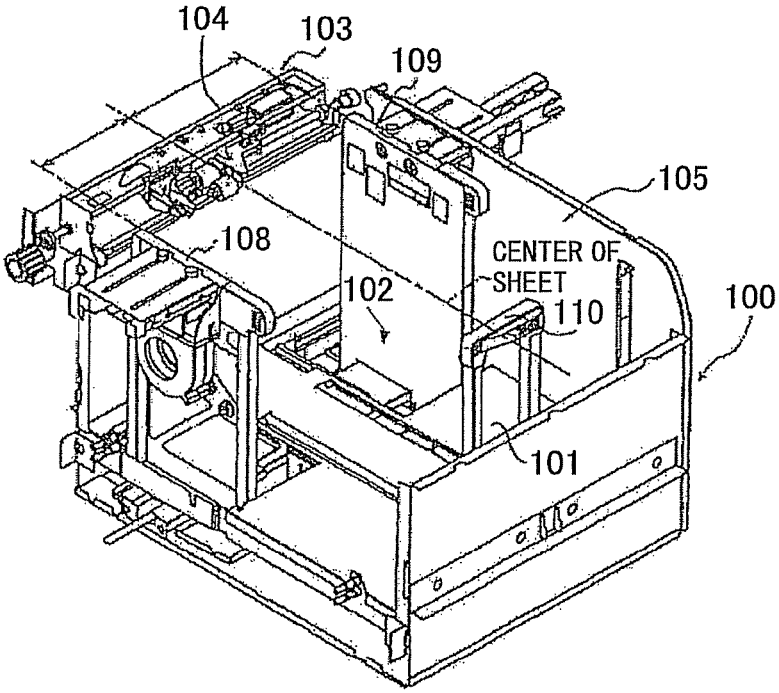
FIG. 3 is a perspective diagram illustrating a feeding device of the image forming apparatus according to the first embodiment.
Figure 4:
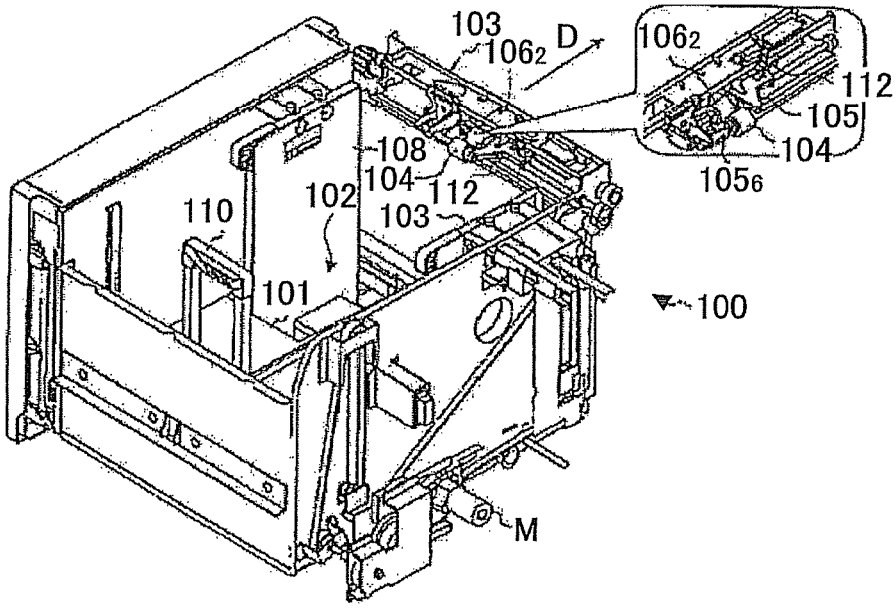
FIG. 4 is a perspective diagram illustrating characteristics of the feeding device of the image forming apparatus according to the first embodiment.

Next, the feeding device 100 of the image forming apparatus according to the first embodiment is described. FIG. 3 is a perspective diagram illustrating the feeding device of the image forming apparatus, and FIG. 4 is a perspective diagram illustrating the characteristics of the feeding device of the image forming apparatus. In this example, the feeding device 100 may be applied as an optionally provided large-capacity feeding device 7. However, the feeding device 100 may have a configuration similar to that of the sheet feeder tray 6.

The feeding device 100 includes a sheet container 102 having a base plate 101 on which the sheets are loaded, a sheet supply unit (feeding unit) 103 configured to acquire a top sheet of the layers of the sheets to supply the acquired top sheet to the main body of the image forming apparatus. The sheet supply unit 103 includes a feed roller 104, a carrying roller 106*a* and a reverse roller 106*b*. These rollers 104, 106*a* and 106*b* are rotationally driven at predetermined timing respectively set in advance. The sheet container 102 includes side fences 108 to guide two sides of the sheets in a width direction (perpendicular to the feeding direction) of the sheets loaded on the base plate 101 and a rear-end restricting member 110 located at a rear part of the sheets and configured to press rear end surfaces of the sheets. Note that the side fences 108 and the rear-end restricting member 110 may be arranged such that the positions of the side fences 108 and the rear-end restricting member 110 are adjustable according to various sizes of the sheets.

An upper limit of a bundle of the sheets may be detected by a sensor 112 formed of a photo-interrupter. A supply position of each of the sheets may be controlled by causing the sensor 112 to detect each of the supply positions of the sheets and allowing a lifting motor M to move the base plate 101 upwards or downwards even if only a small amount of the sheets remains. The upper limit position of the bundle of sheets is optimized such that the upper limit position constantly remains at the same position even if the amount of loaded sheets is increased or decreased.

Note that an actuator 105 configured to operate the sensor 112 is coupled with the feed roller 104 and the carrying roller 106*a*. The upper limit of the bundle of the sheets is constantly detected by allowing a filler arranged at an end of the actuator 105 to shield light of the sensor 112 such that the feed roller 104 constantly remains at a predetermined position. Further, even if the base plate 101 is raised along with the decreased amount of loaded sheets, the upper limit position of the bundle of the sheets is detected by utilizing the actuator 105. The sheet container 102 is configured to be removable from a main body of the feeding device. Hence, the user may remove the sheet container 102 when the user desires to set the sheets in the sheet container 102.

Figure 5:
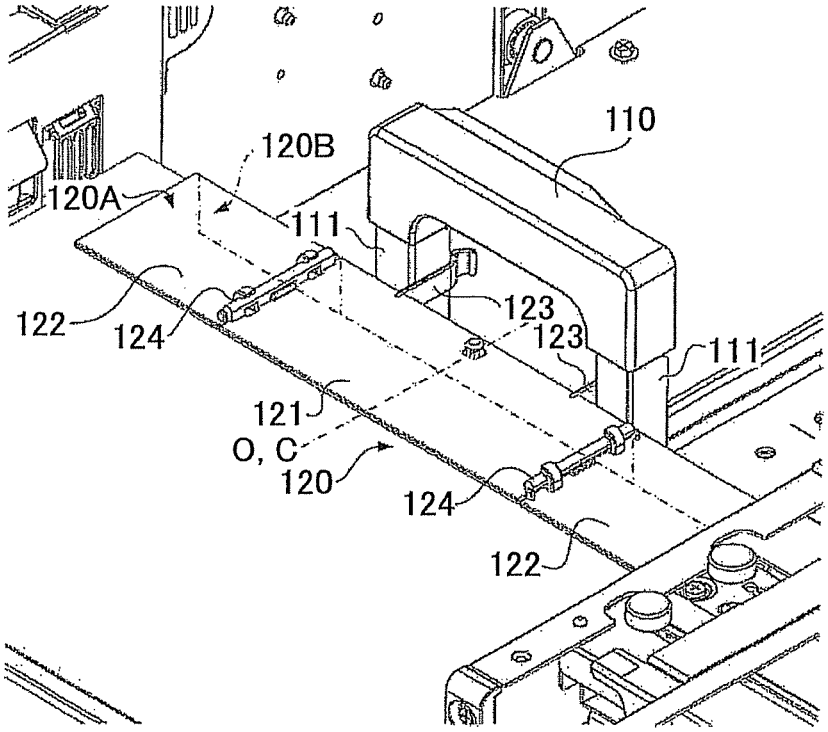
FIG. 5 is a perspective diagram illustrating a major part of the feeding device.
Figure 6A:
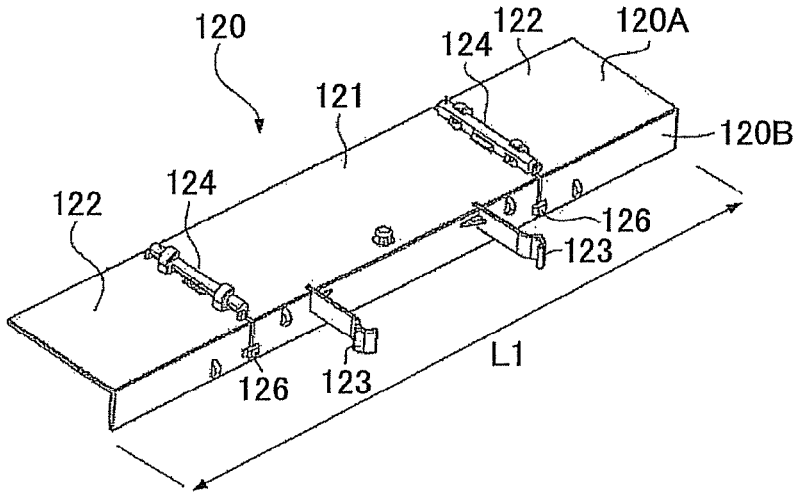
FIGS. 6A and 6B are diagrams illustrating the end fence of the feeding device, where
Figure 6B:
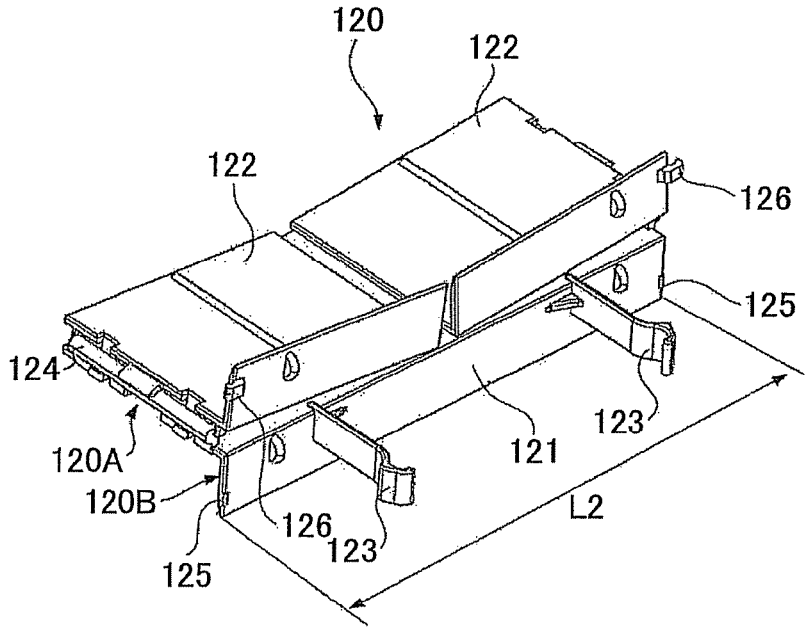
Figure 7:
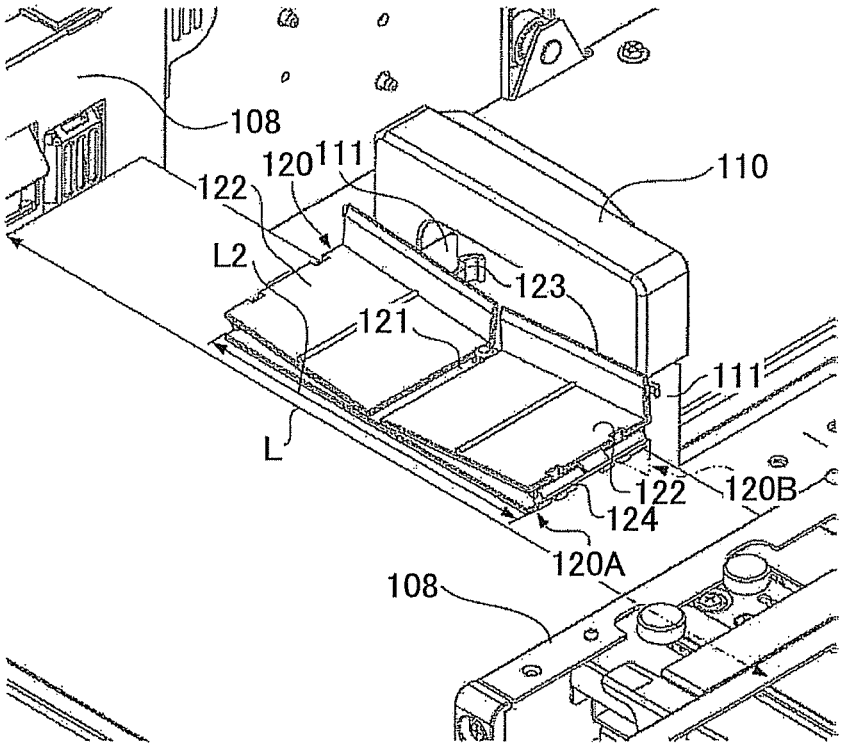
FIG. 7 is a perspective diagram illustrating dimensions of the feeding device in the contracted status.

The feeding device 100 according to the first embodiment may optionally be provided with the end fence 120. When the user desires to set the tab-attached sheets in the feeding device 100, the end fence 120 is attached to the feeding device 100. FIG. 5 is a perspective diagram illustrating a major part of the feeding device. FIGS. 6A and 6B are diagrams illustrating the end fence of the feeding device, where FIG. 6A is a perspective diagram illustrating the end fence in an expanded status, and FIG. 6B is a perspective diagram illustrating the feeding device in a contracted status. FIG. 7 is a perspective diagram illustrating dimensions of the feeding device in the contracted status.

The end fence 120 of the feeding device 100 according to the first embodiment is configured to change a width dimension of the end fence 120 and is arranged above the top sheet of the bundle of the sheets residing in the sheet container 102.

The end fence 120 includes an upper contacting member 120A coming into contact with the upper surface of the top sheet and a restricting member 120B extending from the upper contacting member 120A and downwardly folded toward the rear end of the bundle of the sheets.

The end fence 120 further includes hinges 124 arranged at opposite sides of a base 121 and two expandable movable parts 122 are arranged at the opposite sides of the base 121. Hence, the two movable parts 122 may be expanded based on the respective hinges 124.

The width dimension of the end fence 120 in the first embodiment may be changed to a width dimension L1 or L2 by expanding or contracting the movable parts 122 in the width direction of the sheets in use. Note that the hinges 124 are configured such that the movable parts 122 are folded separately from the base 121 via notches and rotated based on the respective hinges 124. This configuration may not require shaft members or the like. Hence, the number of components forming the feeding device may be reduced, which may consequently reduce the cost of the feeding device.

The end fence 120 is formed of the base 121 having the movable parts 122 on the opposite sides of the base 121 via the respective hinges 124. With this configuration, the movable parts 122 may be expanded in a width dimension via the respective hinges 124 (FIG. 6A: dimension L1). Further, the movable parts 122 may also be inwardly folded via the respective hinges 124 to reduce the width dimension of the end fence 120 (FIG. 6B: dimension L2) from the width dimension of the end fence 120 in the expanded status. The movable parts 122 are axisymmetrically arranged based on a central axis O in the width direction of the end fence 120.

Further, a stopper mechanism may be provided between the base 121 and each of the movable parts 122. The stopper mechanism includes projecting parts 125 formed on opposite ends of the base 121 of the end fence 120 and projecting pieces 126 formed on the base 121 side ends of the movable parts 122. The projecting parts 125 and the projecting pieces 126 are elastically fitted into one another. The projecting parts 125 and the projecting pieces 126 are configured to stop the movements of the movable parts 122 and retain a stopped status of the movable parts 122 in a configuration where the end fence 120 having the movable parts 122 expanded from the base 121 has a maximum dimension in a width direction (i.e., width dimension L1: FIG. 6A). When the base 121 is expanded in the maximum width dimension, the projecting parts 125 and the projecting pieces 126 are fitted into one other to produce a crisp (click) feel.

The crisp (click) feel indicates a bite or resistance that an operator may feel when the operator gradually expands the movable parts 122 to the maximum width by increasing operational force to reach the peak of the operational force and then drastically decreasing the operational force having reached the peak to a predetermined terminating position.

According to the first embodiment, since the crisp (click) feel is acquired when the movable parts 122 are expanded, the operator may be able to feel that the expanding operation is actually performed. Hence, the operator may easily check whether or not the end fence 120 has been folded. Further, since the base 121 and the movable parts 122 are fixed with the projecting parts 125 and the projecting pieces 126, it may be possible to prevent the width dimension of the end fence 120 from being changed by miscellaneous force.

Further, the end fence 120 includes elasticity for being attached to a rear-end restricting member 110, and includes mounting plates 123 formed of plate members. As illustrated in FIG. 5, two mounting plates 123 are arranged on the base 121 and the mounting plates 123 are elastically fitted into internal sides of two legs 111 of the rear-end restricting member 110. With this configuration, the end fence 120 may be easily mounted or dismounted. Further, when the end fence 120 is arranged in this fashion, the central line (axis) O in a width direction of the end fence 120 matches the center C of the sheet (see FIG. 3). Accordingly, the sheets may be stably stopped.

Moreover, even if the movable parts 122 of the end fence 120 are in a folded status, the movable parts 122 are still axisymmetrically arranged. Hence, when the feeding device 100 to which the end fence 120 is attached transfers the sheets, force applied from the end fence 120 to the rear ends of the sheets may be uniformly controlled. As a result, load balance may be uniform to prevent the transfer failure such as oblique transferring of the sheet.

Further, the end fence 120 may be folded to reduce its width dimension. Hence, when the end fence 120 is not utilized in the feeding device, the end fence 120 may be stored in a small space outside the feeding device.

According to the first embodiment, when a minimum width dimension (L2) of the end fence 120 is equal to or less than a minimum interval dimension (L) between two side fences 108 (i.e., L≥L2), the end fence 120 may be easily arranged between the side fences 108 as illustrated in FIG. 7.

Further, the color applied to the end fence 120 differs from that applied to the sheet container 102. Hence, it may be easy to recognize the end fence 120 so as to determine the presence or absence of the end fence 120.

Further, according to the first embodiment, the color applied to the base 121 of the end fence 120 and the color applied to the movable parts 122 of the end fence 120 are mutually different. Hence, it may be reliably determined whether the end fence 120 is folded.

[Second Embodiment]

Figure 8A:
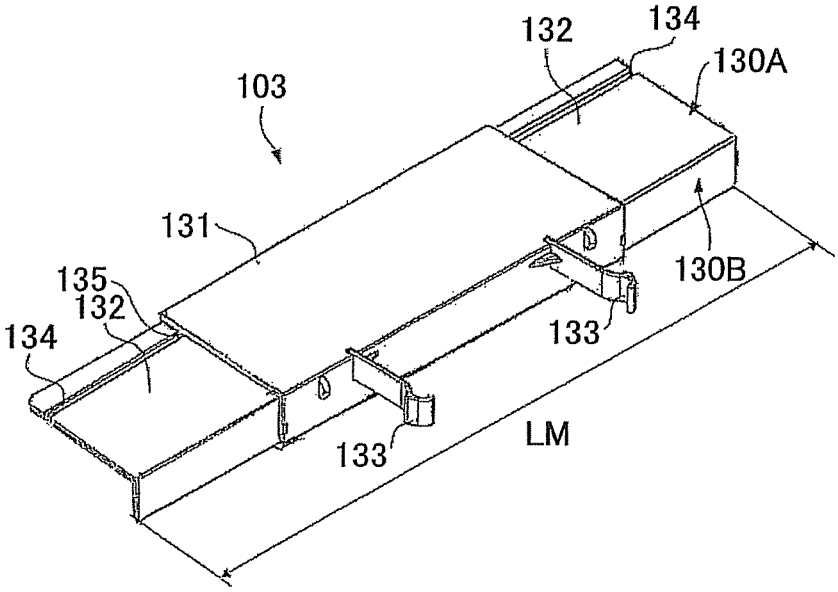
FIGS. 8A and 8B are perspective diagrams illustrating an end fence of a feeding device according to a second embodiment.
Figure 8B:
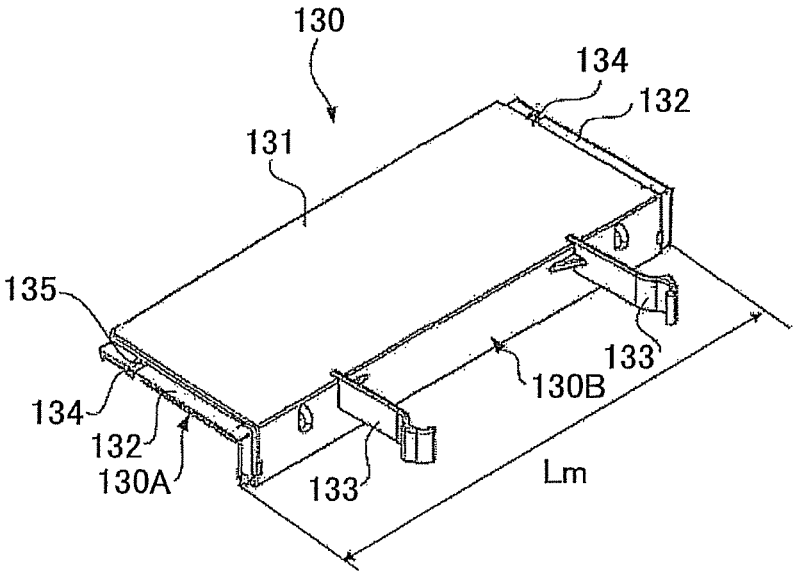
Figure 9A:
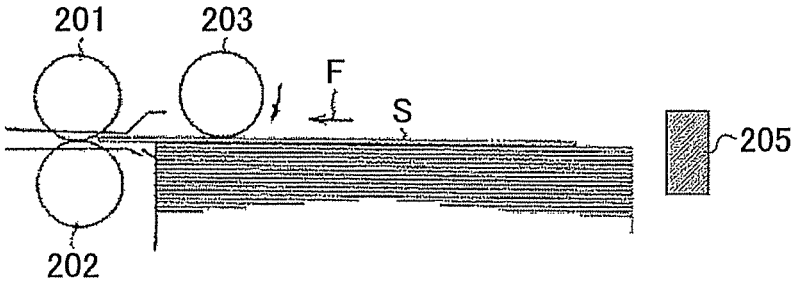
FIGS. 9A, 9B and 9C are cross-sectional diagrams illustrating a related art feeding device.
Figure 9B:
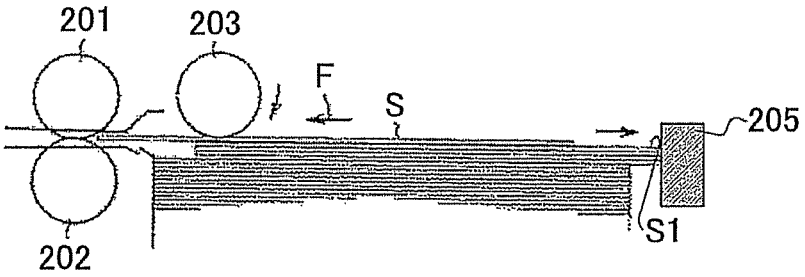
Figure 9C:
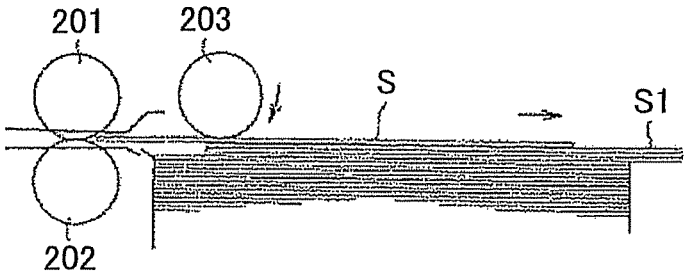
Figure 10:
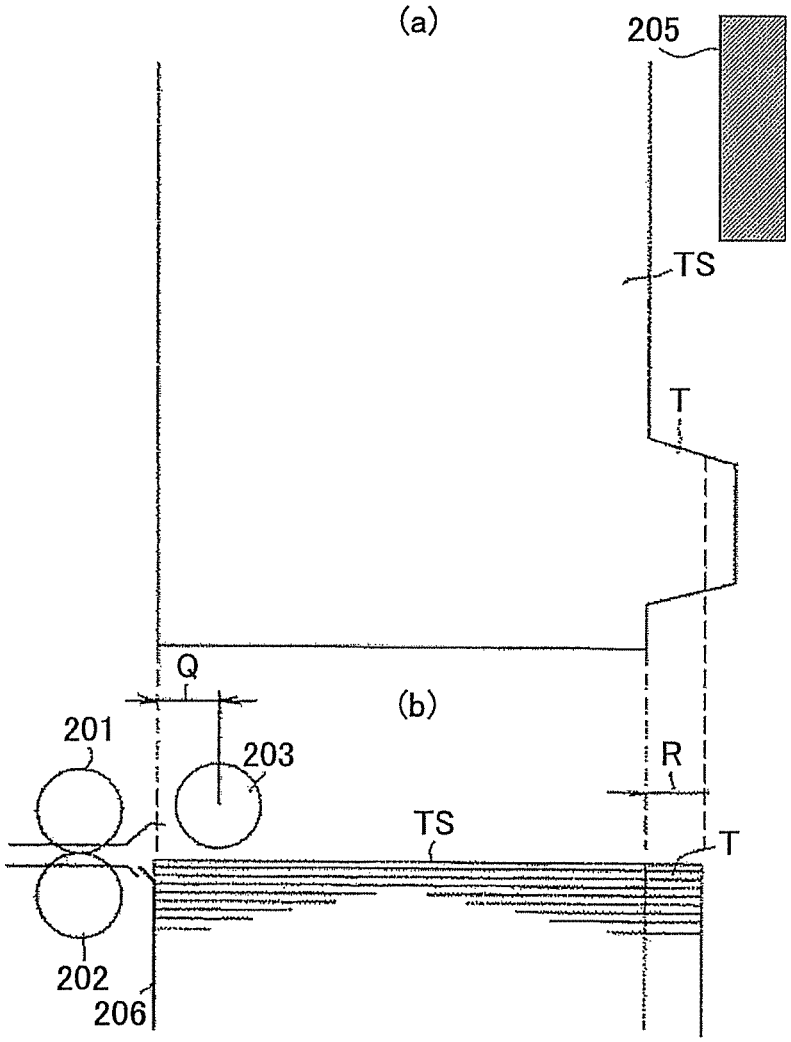
FIG. 10 is a diagram illustrating arrangement of a tab-attached sheet, where (a) is a plan diagram of the tab-attached sheet and (b) is a schematic side diagram illustrating layers of the tab-attached sheets loaded on a feed stand.
Figure 11A:
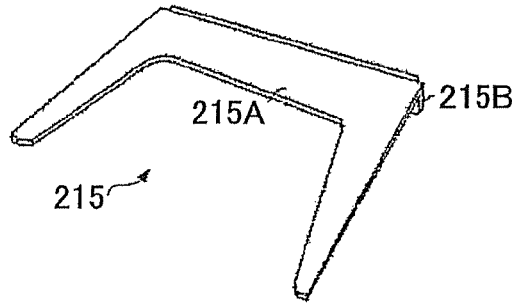
FIGS. 11A, 11B and 11C are diagrams illustrating a related art feeding device compatible with the tab-attached sheet, where
Figure 11B:
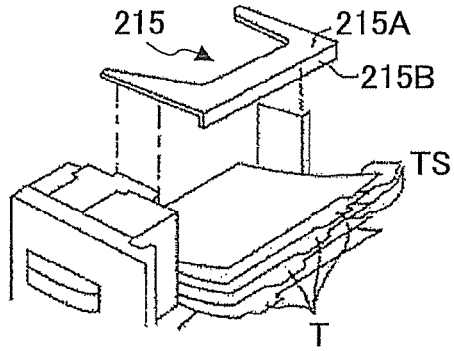
Figure 11C:
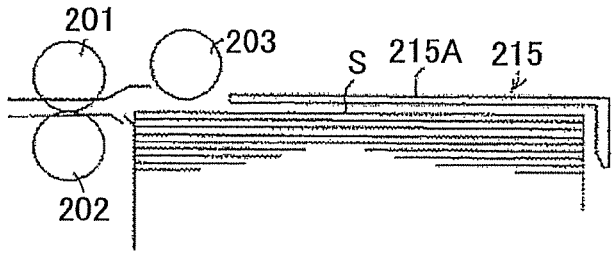

Next, an end fence 130 for use in the feeding device according to a second embodiment is described. FIGS. 8A and 8B are perspective diagrams illustrating the end fence 130 of the feeding device according to the second embodiment. FIG. 8A illustrates the end fence 130 in an expanded status in a width direction and FIG. 6B illustrates the feeding device 130 in a contracted status in the width direction.

The end fence 130 according to the second embodiment includes an upper contacting member 130A coming into contact with the bundle of the sheets loaded in the sheet container 102 and a restricting member 130B extending downwardly from the upper contacting member 130A along rear end surfaces of the bundle of the sheets. Further, the end fence 130 may accommodate (store) two movable parts inside a base 131 by sliding the movable parts 132 in a width direction of the end fence 130. Further, mounting plates 133 are formed on the end fence 130 such that the end fence 130 may be attached to a rear-end restricting member 110 via the mounting plates 133.

The movable parts 132 include respective grooves 134 formed along a sliding direction, and the base 131 includes a guiding projection that is fitted into the grooves 134. Accordingly, the movable parts 132 may be guided by the guiding projection fitted into the grooves 132.

The width dimension of the end fence 130 may be adjustable in a range from the maximum width LM (see FIG. 8A) to the minimum width Lm (see FIG. 8B) by adjusting an accommodated status of the movable parts 132 inside the base 131.

The end fence 120 according to the second embodiment may include a latch configuration in which a plate spring is arranged between the grooves 134 and guiding projection 135, or may employ projections and frictional members. With arrangement of such mechanisms in the end fence 130, the movable parts 132 may be fixed at any desirable positions. Further, the operator may physically recognize the expansion or contraction of the movable parts 132 with a crisp (click) feel or the sense of resistance.

In the end fence 130 according to the second embodiment, the movable parts 132 may be accommodated (stored) in the base 131. Hence, the end fence 130 according to the second embodiment may have a smooth configuration without having any projections and recesses in appearance. With this configuration, an operation manual of the end fence 130 may be attached to the upper surfaces of the movable parts 132, such that operational information may be displayed for operators.

According to the aforementioned embodiment, there is provided a feeding device that includes a carrying roller configured to carry a top sheet from a bundle of loaded sheets in a conveying direction; a reverse roller configured to transfer subsequent sheets subsequently layered beneath the top sheet in a direction opposite to the conveying direction while the subsequent sheets being moved in the conveying direction together with the top sheet; and an end fence configured to restrict rear end positions of the subsequent sheets transferred in the direction opposite to the conveying direction. In the feeding device, the end fence includes an upper contacting member configured to come into contact with an upper surface of the top sheet; and a restricting member extending from the upper contacting member along a rear end surface of the bundle of the loaded sheets and configured to stop rear ends of the sheets in an entire width direction of the sheets by allowing the rear ends of the sheets to come into contact with the restricting member, the upper contacting member and the restricting member of the end fence being arranged such that a width dimension of the end fence is changeable in a width direction of the sheets, and the end fence being arranged above the top sheet of the bundle of the loaded sheets.

The feeding device according to the embodiment further includes a rear-end restricting member arranged in a sheet container and configured to restrict a position of the bundle of the loaded sheets by allowing a rear end of the bundle of the loaded sheets to come into contact with the rear-end restricting member, the end fence being attached to the rear-end restricting member.

In the feeding device according to the embodiment, the end fence is axisymmetrically formed corresponding to a central line in a width direction of the end fence.

In the feeding device according to the embodiment, when the width dimension of the end fence is changed such that a changed width dimension of the end fence is determined as L2 and a minimum interval dimension between side fences configured to restrict opposite sides of the bundle of the sheets is determined as L, a relationship between L and L2 is represented by L≥L2.

In the feeding device according to the embodiment, the end fence further includes a base; hinges arranged at opposite ends of the base; and movable parts rotationally arranged on the respective hinges, the width dimension of the end fence being changed by folding the movable parts along the respective hinges.

In the feeding device according to the embodiment, the end fence further includes a base; and movable parts configured to be slidably accommodated in the base to be slidably set at any positions, the width dimension of the end fence being changed by causing the movable parts to be accommodated in the base.

In the feeding device according to the embodiment, the end fence further includes a stopper mechanism between the base and the movable parts, the stopper mechanism being configured to elastically stop movements of the movable parts and retain a stopped status of the movable parts when the width dimension of the end fence reaches a predetermined width by moving the movable parts from the base.

The feeding device according to the embodiment further includes a sheet container configured to contain the bundle of the sheets, the end fence including a color differing from a color of the sheet container.

In the feeding device according to the embodiment, the base includes a color differing from a color of the movable parts.

According to the aforementioned embodiment, there is provided an image forming apparatus including the aforementioned feeding device; and an image forming unit configured to form an image on a desired one of the sheets transferred from the feeding device.

According to the embodiments, the width dimension of the end fence may be changed. Hence, various types of tab-attached sheets may be utilized in the feeding device of the image forming apparatus without replacing the end fence.

All examples and relationshipal language recited herein are intended for pedagogical purposes to aid the reader in understanding the principles of the invention and the concepts contributed by the inventor to furthering the art, and are to be construed as being without limitation to such specifically recited examples and relationships, nor does the organization of such examples in the specification relate to a showing of the superiority or inferiority of the invention. Although the embodiment of the present invention has been described in detail, it should be understood that various changes, substitutions, and alterations could be made hereto without departing from the spirit and scope of the invention.

This patent application is based on Japanese Priority Patent Application No. 2011-128594 filed on Jun. 8, 2011, the entire contents of which are hereby incorporated herein by reference.

What is claimed is:

1. A feeding device, comprising:

a carrying roller configured to carry a top sheet from a bundle of loaded sheets in a conveying direction;

a reverse roller configured to transfer subsequent sheets subsequently layered beneath the top sheet in a direction opposite to the conveying direction while the top sheet is carried in the conveying direction; and an end fence configured to restrict rear end positions of the subsequent sheets transferred in the direction opposite to the conveying direction, wherein the end fence includes:

an upper contacting member configured to come into contact with an upper surface of the top sheet; and a restricting member extending from the upper contacting member along a rear end surface of the bundle of the loaded sheets and configured to stop rear ends of the sheets by allowing the rear ends of the sheets to come into contact with the restricting member, the restricting member and the upper contacting member of the end fence having a longitudinal length that is configured to span a width of the sheets, the upper contacting member and the restricting member of the end fence being upwardly foldable to allow the longitudinal length of the end fence to be changeable to match a width of different sizes of sheets, the end fence being arranged above the top sheet of the bundle of the loaded sheets, the upwardly foldable upper contacting member and restricting member pivoting on a pivot axis that is about parallel to the conveying direction.

2. The feeding device as claimed in claim 1, further comprising:

a rear-end restricting member arranged in a sheet container and configured to restrict a position of the bundle of the loaded sheets by allowing a rear end of the bundle of the loaded sheets to come into contact with the rear-end restricting member, the end fence being attached to the rear-end restricting member.

3. The feeding device as claimed in claim 1, wherein the end fence is axisymmetrically formed corresponding to a central line in a width direction of the end fence.

4. The feeding device as claimed in claim 1, wherein when the longitudinal length of the end fence is changed such that a changed longitudinal length of the end fence is determined as L2 and a minimum interval dimension between side fences configured to restrict opposite sides of the bundle of the sheets is determined as L, a relationship between L and L2 is represented by $L \geq L2$.

5. The feeding device as claimed in claim 1, wherein the end fence further includes:

a base;

hinges arranged at opposite ends of the base; and movable parts rotationally arranged on the respective hinges.

6. The feeding device as claimed in claim 5, wherein the end fence further includes a stopper mechanism between the base and the movable parts, the stopper mechanism being configured to elastically stop movements of the movable parts and retain a stopped status of the movable parts when the longitudinal length of the end fence reaches a predetermined length by moving the movable parts from the base.

7. The feeding device as claimed in claim 1, further comprising:

a sheet container configured to contain the bundle of the sheets, the end fence including a color differing from a color of the sheet container.

8. The feeding device as claimed in claim 5, wherein the base includes a color differing from a color of the movable parts.

9. An image forming apparatus comprising:

the feeding device as claimed in claim 1; and an image forming unit configured to form an image on a desired one of the sheets transferred from the feeding device.

* * * * *